US008714967B2

(12) United States Patent
Garrison

(10) Patent No.: US 8,714,967 B2
(45) Date of Patent: May 6, 2014

(54) HIGH VELOCITY BURNER APPARATUS AND METHOD

(76) Inventor: Roy Lee Garrison, Cantonment, FL (US)

( * ) Notice: Subject to any disclaimer, the term of this patent is extended or adjusted under 35 U.S.C. 154(b) by 1021 days.

(21) Appl. No.: 12/660,113

(22) Filed: Feb. 19, 2010

(65) Prior Publication Data

US 2011/0207059 A1 Aug. 25, 2011

(51) Int. Cl.
*F02M 27/04* (2006.01)

(52) U.S. Cl.
USPC ..... 431/2; 210/222

(58) Field of Classification Search
CPC ..... F02M 27/04; F02M 27/045
USPC ..... 431/2; 123/143 R, 527, 528, 529; 48/3 R, 48/180.1, 189.2
See application file for complete search history.

(56) References Cited

U.S. PATENT DOCUMENTS 1,430,327 A * 9/1922 Sauer ..... 431/243
1,584,452 A * 5/1926 Hazard ..... 431/2
2,095,230 A * 10/1937 Camerino ..... 415/211.1
3,349,354 A * 10/1967 Miyata ..... 335/209
3,971,539 A * 7/1976 Goto et al. ..... 422/186.02
3,984,196 A * 10/1976 Zenkner ..... 431/5
4,170,447 A * 10/1979 Goldstein et al. ..... 423/215.5
4,201,140 A * 5/1980 Robinson ..... 110/218
4,716,024 A * 12/1987 Pera ..... 422/186.01
4,826,592 A * 5/1989 Taylor ..... 210/223
5,348,050 A * 9/1994 Ashton ..... 137/827
5,363,780 A * 11/1994 Whitney ..... 110/346
5,637,226 A * 6/1997 Adam et al. ..... 210/695
5,958,282 A * 9/1999 Raj et al. ..... 252/62.52
2007/0272201 A1* 11/2007 Amano et al. ..... 123/295
2008/0302001 A1* 12/2008 Koivusalmi et al. ..... 44/308

FOREIGN PATENT DOCUMENTS

WO WO 2006126905 A2 * 11/2006

* cited by examiner

*Primary Examiner* — Kang Hu
*Assistant Examiner* — Deepak Deean
(74) *Attorney, Agent, or Firm* — J. Nevin Shaffer, Jr.

(57) ABSTRACT

A high velocity burner apparatus and method includes an air intake funnel and an air-fluid mixer connected with the air intake funnel. A fluid input is connected with the air-fluid mixer. A magnetic tube container with an entrance and an exit is provided where the entrance is connected with the air-fluid mixer and where the magnetic tube container includes a plurality of individual magnetic tubes connected within the magnetic tube container such that adjacent magnetic tubes are misaligned with each other. An air suction device is connected with the exit of the magnetic tube container such that suction is applied through the magnetic tube container to the air intake funnel and a burner device is connected with the air suction device for burning fluid that passes through the magnetic tube container.

20 Claims, 3 Drawing Sheets

HIGH VELOCITY BURNER APPARATUS AND METHOD

FIELD OF THE INVENTION

This invention relates to a high velocity burner apparatus and method. In particular, in accordance with one embodiment, the invention relates, to a high velocity burner apparatus with an air intake funnel and an air-fluid mixer connected with the air intake funnel. A fluid input is connected with the air-fluid mixer. A magnetic tube container with an entrance and an exit is provided where the entrance is connected with the air-fluid mixer and where the magnetic tube container includes a plurality of individual magnetic tubes connected within the magnetic tube container such that adjacent magnetic tubes are misaligned with each other. An air suction device is connected with the exit of the magnetic tube container such that suction is applied through the magnetic tube container to the air intake funnel and a burner device is connected with the air suction device for burning fluid that passes through the magnetic tube container.

BACKGROUND OF THE INVENTION

Devices which can combust or burn fuel have been around for many centuries. Burners serve many useful and necessary functions as heat sources for power creation, for simple warmth and habitability functions, and for use as devices to dispose of noxious solids and fluids, i.e. as incinerators, for example only. Certainly, if possible, a burner that can accomplish all of these functions is an incredibly useful device.

Problems with prior art devices are legion. That is, when burning liquid fuel, the fuel must typically be a very highly refined fuel and it must be introduced into the burner in very small amounts through equally small input ports such as through fuel injectors. These requirements result in added time and costs in cleaning and repairing and replacing injectors thus limiting the usefulness of such burners.

When prior art burners are designed to accommodate more basic, less refined fuels containing some amount of solid material, these input, injector, problems are exacerbated. Additionally, prior art burners of less refined fuels, bio fuels, etc., often create unacceptably high levels of toxic byproducts such as toxic smoke, gas, and residue which must be treated and properly disposed. This greatly limits the attractiveness of non-standard, "green" fuels and the like.

One prior art strategy to increase the effectiveness of a burner is to greatly increase the amount of ambient air or oxygen introduced to the burner in order to attempt to improve the burn capacity. This results, however, in adding expense and complexity to the burner and thus limits the usefulness of this strategy.

Thus, there is a need in the art for a burner that is effective, efficient and affordable. It, therefore, is an object of this invention to provide a burner that meets those requirements and that can burn any processed and virtually all semi-processed liquid fuels, including liquid fuels with solid material. It is a further object that the burner does not require precision fuel injectors and that a single injector, in fact, may be used no matter what the fuel source. Another object of the invention is that it reduce unwanted emission solids and gasses and more completely burns the fuel while not requiring elaborate increased oxygen delivery systems or the like.

SUMMARY OF THE INVENTION

Accordingly, the high velocity burner apparatus of the present invention, according to one embodiment includes an air intake funnel and an air-fluid mixer connected with the air intake funnel. A fluid input is connected with the air-fluid mixer. A magnetic tube container with an entrance and an exit is provided where the entrance is connected with the air-fluid mixer and where the magnetic tube container includes a plurality of individual magnetic tubes connected within the magnetic tube container such that adjacent magnetic tubes are misaligned with each other. An air suction device is connected with the exit of the magnetic tube container such that suction is applied through the magnetic tube container to the air intake funnel and a burner device is connected with the air suction device for burning fluid that passes through the magnetic tube container.

In another aspect of the invention, the fluid input is connected at approximately a right angle with the air-fluid mixer such that fluid introduced into the air-fluid mixer enters the air-fluid mixer at approximately a right angle to air entering the air-fluid mixer. In one aspect, the magnetic tube container encompasses an interior space with sides and a center and the plurality of individual magnetic tubes are connected within the magnetic tube container across the approximate center of the magnet tube container from side to side. In a further aspect, the plurality of magnetic tubes are connected within the magnetic tube container in an approximate spiral pattern as viewed from the entrance such that air and fluid passing through the magnetic tube container is caused to move around the plurality of individual magnetic tubes in at least a partially spiral motion. In one aspect, the plurality of individual magnetic tubes are hollow tubes filled with a liquid magnetic solution.

In another aspect, the air suction device is a blower with a suction and an exhaust where the suction is connected with the exit of the magnetic tube container and the exhaust is connected with the burner device. In one aspect, the fluid input is connected with a fuel source and directs fuel into the air-fluid mixer. In another aspect the fuel is a bio fuel and in a further aspect the fuel is a waste slurry.

According to another embodiment of the invention, a high velocity burner apparatus includes an air intake funnel where the air intake funnel includes a mouth and a throat where the mouth is larger in dimension than the throat. An air-fluid mixer is connected with the air intake funnel. A fluid input is connected with the air-fluid mixer where the fluid input is connected at approximately a right angle with the air-fluid mixer such that fluid introduced into the air-fluid mixer enters the air-fluid mixer at approximately a right angle to air entering the air-fluid mixer. A magnetic tube container is provided with an entrance and an exit where the entrance is connected with the air-fluid mixer, where the magnetic tube container encompasses an interior space with sides and a center and where the magnetic tube container includes a plurality of individual magnetic tubes connected with the sides within the magnetic tube container such that adjacent magnetic tubes are misaligned with each other and where the plurality of individual magnetic tubes are connected within the magnetic tube container across the approximate center of the magnet tube container from side to side. An air suction device is connected with the exit of the magnetic tube container such that suction is applied through the magnetic tube container to the air intake funnel and a burner device is connected with the air suction device for burning fluid that passes through the magnetic tube container.

In another aspect of this invention, the plurality of magnetic tubes are connected within the magnetic tube container in an approximate spiral pattern as viewed from the entrance such that air and fluid passing through the magnetic tube container is caused to spiral. In one aspect, the plurality of magnetic tubes are hollow tubes filled with a liquid magnetic solution.

In a further aspect, the air suction device is a blower with a suction and an exhaust where the suction is connected with the exit of the magnetic tube container and the exhaust is connected with the burner device. In one aspect, the fluid input is connected with a fuel source and directs fuel into the air-fluid mixer. In another aspect, the fuel is a bio fuel and in another aspect the fuel is a waste slurry.

According to another embodiment, a high velocity burner method includes the steps of: providing a high velocity burner with an air intake funnel, an air-fluid mixer connected with the air intake funnel, a fluid input connected with the air-fluid mixer, a magnetic tube container with an entrance and an exit where the entrance is connected with the air-fluid mixer and where the magnetic tube container includes a plurality of individual magnetic tubes connected within the magnetic tube container such that adjacent magnetic tubes are misaligned with each other, an air suction device connected with the exit of the magnetic tube container such that suction is applied through the magnetic tube container to the air intake funnel and a burner device connected with the air suction device for burning fluid that passes through the magnetic tube container; and then connecting a fluid source with the fluid input.

In another aspect of the invention, the plurality of magnetic tubes are hollow tubes filled with a liquid magnetic fluid. In a further aspect the fluid source is a bio fuel and in one aspect the fluid source is a waste slurry.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
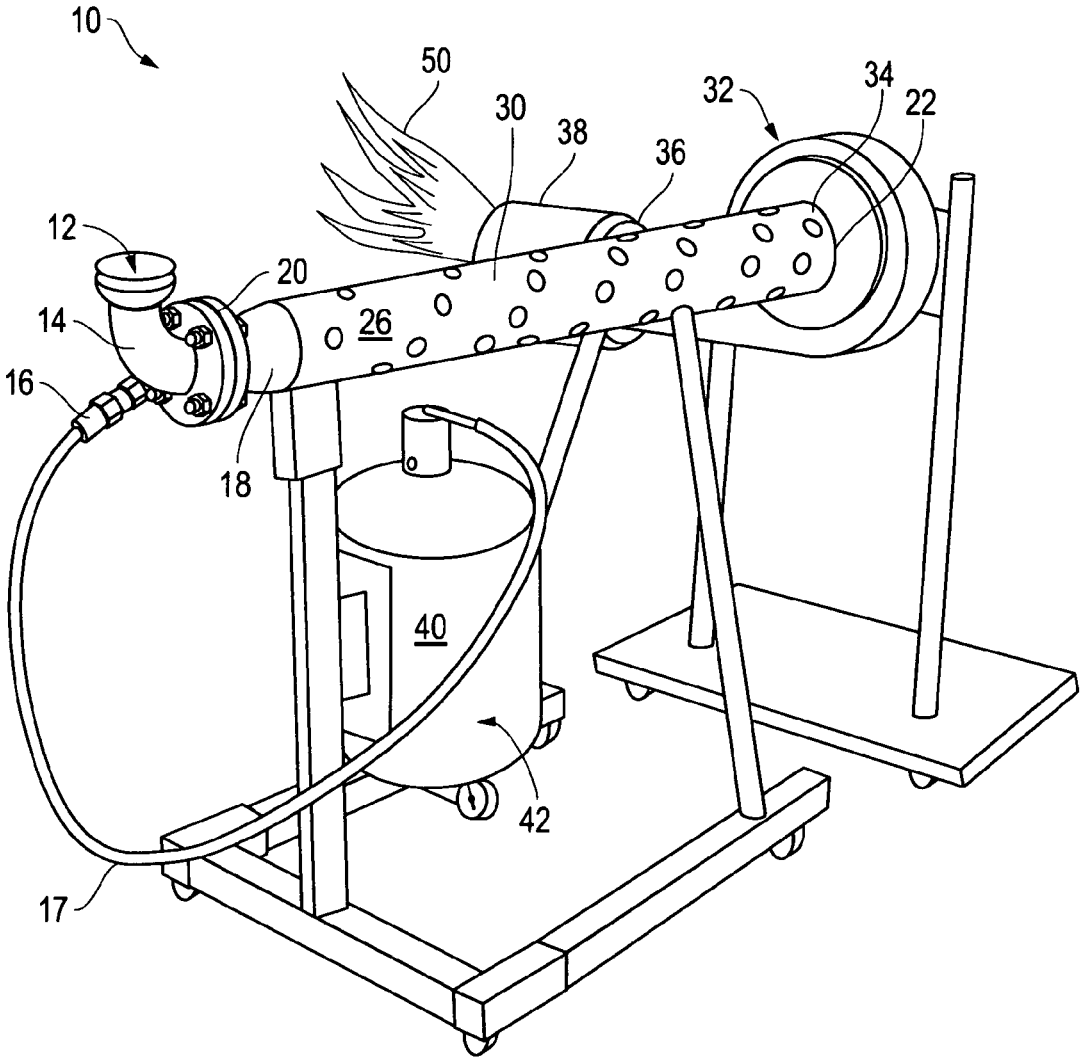
FIG. 1 is a perspective view of the high velocity burner according to one embodiment.
Figure 2:
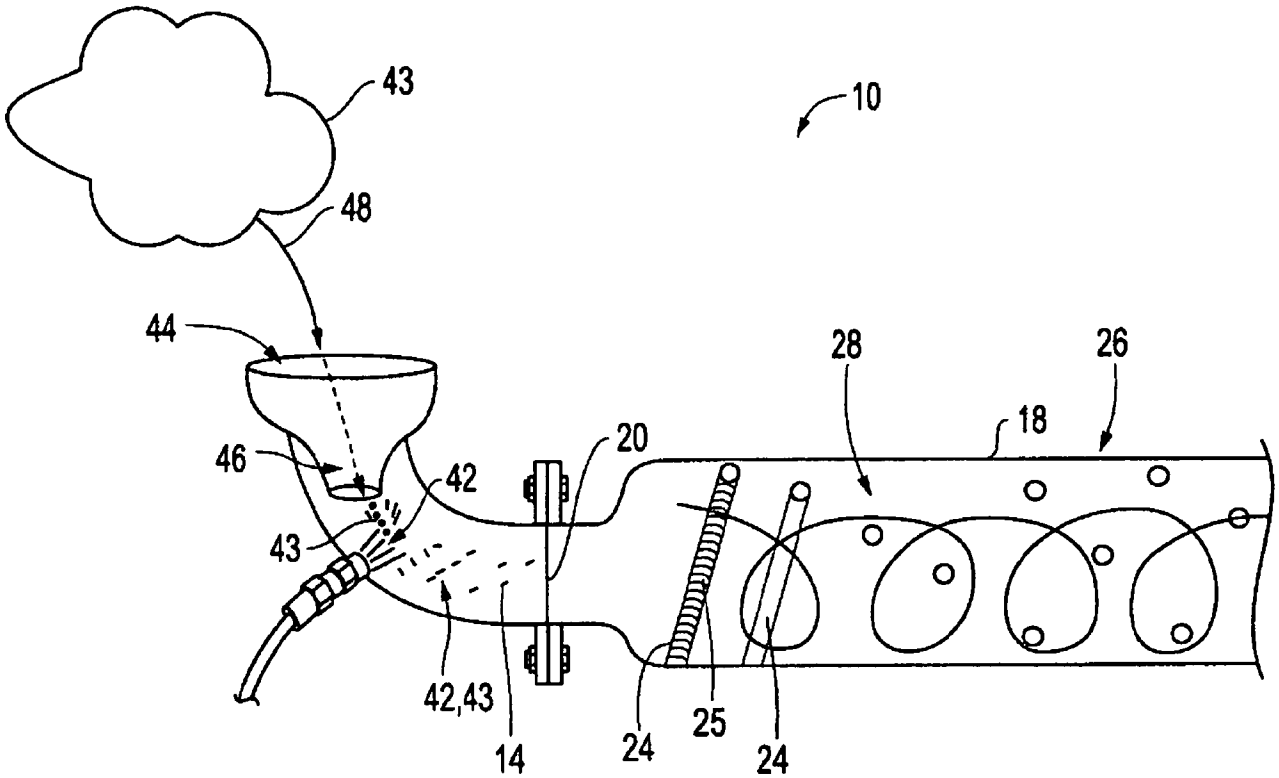
FIG. 2 is side partial section view of the invention of FIG. 1.
Figure 3:
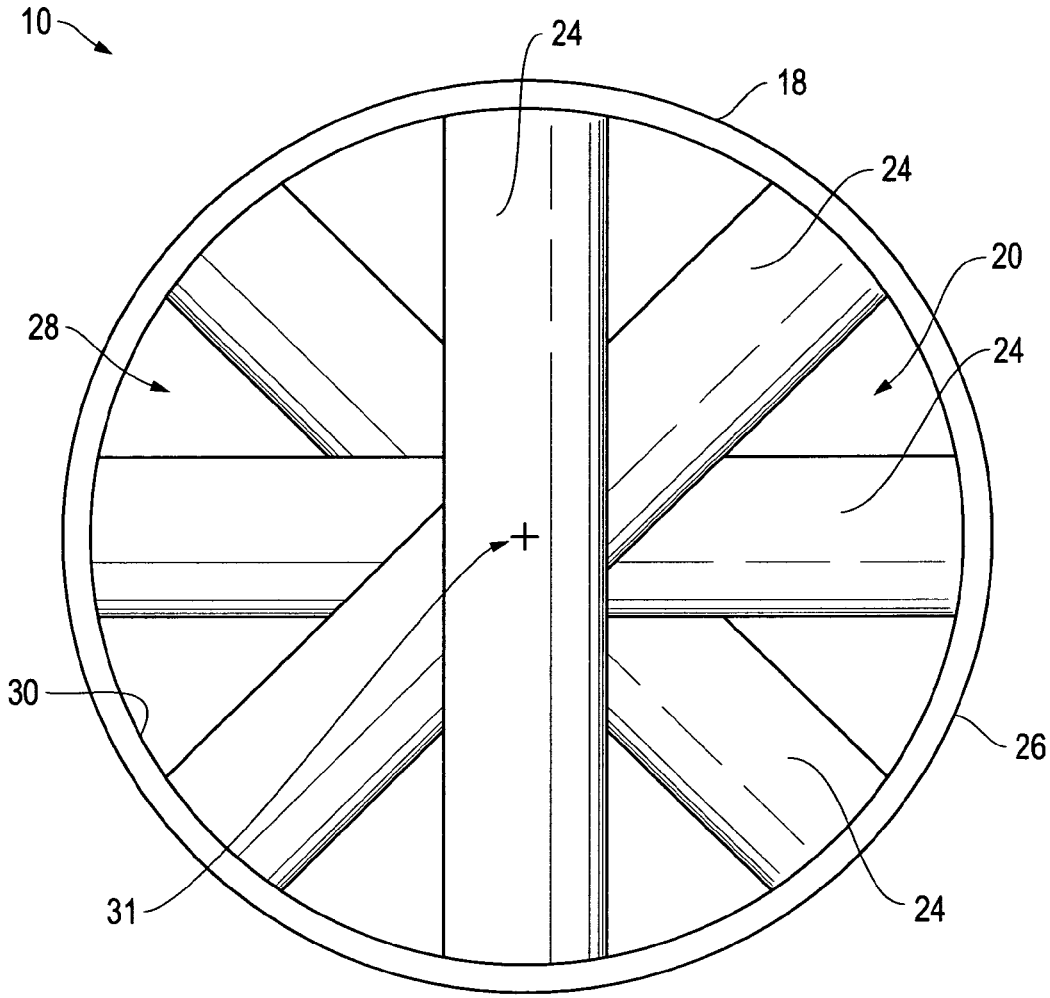
FIG. 3 is an end view of the magnetic tube container showing the spiraling location of the magnetic tubes with the magnetic tube container according to the invention of FIG. 1.

The preferred embodiment of the present invention is illustrated by way of example in FIGS. 1-3. With specific reference to FIG. 1, high velocity burner 10 includes and air intake funnel 12. An air-fluid mixer 14 is connected with the air intake funnel 12. Fluid input 16 is connected with air-fluid mixer 14. Magnetic tube container 18 has an entrance 20 and an exit 22. Entrance 20 is connected with air fluid mixer 14.

Magnetic tubes 24 are connected inside of magnetic tube container 18. In that regard, magnetic tube container has an outside 26 and an inside 28 formed of sides 30. As shown in the figures, magnetic tube container 18 is tube shaped itself as in the form of a pipe with a unitary side 30. Certainly, there is no limitation as to the geometry of magnetic tube container 18 and it could be any desired form so long as it included an inside 28 for the containment of magnetic tubes 24. In the same manner, magnetic tubes 24 are preferably pipe shaped tubes as illustrated but may be any desirable form.

Magnetic tubes 24 are connected on the inside 28 of magnetic tube container 18 from side 30 to side 30 across the approximate center 31 (indicated by a "+" mark in FIG. 3) of the magnetic tube container 18 as illustrated more fully in FIG. 3. Importantly, preferably, each magnetic tube 24 is misaligned with the magnetic tube 24 closest to it. That is, each magnetic tube 24 is rotated slightly from the last magnetic tube 24. This feature of the invention, Applicant has determined, is required to ensure that an air-fluid flow through the inside 28 of magnetic tube container 18 is not simply a direct pass through but rather the air-fluid flow is disrupted and directed around and into each successive magnetic tube 24. Preferably, the magnetic tubes 24 are connected in a "spiral" form on the inside 28 of magnetic tube container 18 as more clearly shown in FIG. 3. This causes the air-fluid mixture to at least partially spiral as it moves through the inside 28 of magnetic tube container 18. Again, Applicant has determined that this spiral or rotating motion more completely ensures that the air-fluid mixture comes in contact with each successive magnetic tube 24 for greatest effect, as will be more fully described hereafter.

Still referring to FIG. 1, an air suction device 32 is connected with the exit 22 of the magnetic tube container 18 such that suction is applied through the magnetic tube container 18 to air intake funnel 12. Air suction device 32 may be a blower as is known in the art with a suction end 34 and an exhaust end 36. Suction end 34 is connected with the exit 22 of the magnetic tube container 18 and as a result applies a significant suction, ultimately, to the air intake funnel 12. Applicant has determined that a high velocity blower, such as is typical of the performance compressor blowers currently used in motor sports for obtaining a powerful suction displacement discharge, is suitable for the purposes of the invention. By "high velocity" it is meant, as used herein, speeds of about 800 feet per second or more.

Thereafter, exhaust end 36 of air suction device 32 is connected with a burner device 38. Burner device 38 burns the air-fluid mixture that has passed through the inside 28 of magnetic tube container 18 and over and around each of the magnetic tubes 24 connected on the inside 28. Burner device 38 is preferably a burner such as burners used in creating hot mix asphalt as are known in the art.

By way of further explanation, magnetic tubes 24 are magnetized such that they exert a powerful magnetic force on the air-fluid mixture as it passes by. The creation of a series of misaligned magnetic tubes 24 has been found to greatly increase the effectiveness of the ability of the burner device 38 to consume or burn the mixture. In fact, Applicant has found that the high velocity burner 10 of the present invention is so effective that it burns so called bio-fuel completely and even can efficiently burn waste slurry. It is believed that the effect the magnetic tubes 24 have on the cellular structure of the fluid being burned is such that it enables the fluid to be almost completely consumed leaving no toxic debris or gases.

Applicant understands the invention to be a large scale electrical component, structured such that the physical material flowing through it comes into contact with electrical and physical forces which affect the molecular geometry and atomic positions of the material. The magnetic effect enhances conductivity inside the magnetic tube container 18. This produces flux density lines in which electron flow is generated by what Applicant understands to be a magneto hydrodynamic or "MHD" effect. Freed electrons or "static" electricity is enabled and then directed through the helical spiral created by the above described misaligned placement of the magnetic tubes 24. This apparently ensures that freed electrons are most likely to strike other covalent bonds being shared by the molecular structures of the fuel type being used. This breaks shared bonds and produces a molecular scale de-manufacturing process similar to electrolysis but in a much faster and greatly improved fashion. This invention and process methodology for generating an electromotive force and then directing such electrical energy through any mass fuel and air mixture flowing through the invention is a new improved process for enabling the starting of fire and in doing so improving the over all combustion and oxidation process by way of the pre-combustion environment made possible by the invention itself where the combustible molecules are geometrically better positioned whereby oxygen can react with the carbon more efficiently as well as many complex molecular structures which are more difficult if not normally impossible to combust are de-manufactured by the breaking of the covalent bonds and then made combustible such as is the effect of this invention on H2O.

Still referring to FIG. 1, fuel source 40 is shown as a cylinder containing a fuel 42, such as bio fuel or waste slurry, as described above. Fluid input 16 is connected with fuel source 40 and with air-fluid mixer 14 as described above. Fuel source 40 may be under pressure or include a pump, not shown, in order to ensure a continuous flow of fuel 42 through fluid input 16, by means of a connecting hose 17, for example, to air-fluid mixer 14.

Referring now to FIG. 2, a partial cross section partial view of the high velocity burner 10 is shown in which air intake funnel 12 may be seen to include a mouth 44 and a throat 46. Mouth 44 is wider than throat 46, preferably, as illustrated and extends beyond air-fluid mixer 14. Throat 46 extends within air-fluid mixer 14, as shown. This ensures a smooth flow of air 43 directly into the air-fluid mixer 14 and focuses the air 43 in the direction of direction arrow 48. According to one aspect of the invention, fluid input 16 is connected with air-fluid mixer 14 at approximately a right angle so that fuel 42 is introduced into air-fluid mixer 14 at right angles, or approximately thereto, to the flow of air 43 into air-fluid mixer 14. Applicant has determined that this arrangement ensures an initial air-fluid mixing and dispersion of the air 43 within the fuel 42 prior to passage through the inside 28 of magnetic tube container 18 and past the plurality of magnetic tubes 24 and greatly increases the effectiveness of the invention.

Importantly, Applicant has determined that the high velocity burner 10 of the present invention is so efficient at burning all types of fuels 42, even fuels with solid materials in them such as waste slurry, that fluid input 16 does not need to be a small highly calibrated, and prone to break down due to clogging, fuel injector. Instead, Applicant's fluid input 16 can be a relatively large injector that does not clog when such unrefined fuels are used.

Another important aspect of the present invention concerns magnetic tubes 24. Again, these tubes are highly magnetized and may be any magnets now known or hereafter developed. According to one aspect, however, Applicant has determined that magnetic tubes 24 filled with a liquid magnetic solution 25 provides the best results. Applicant has determined that a liquid magnetic solution 25 created from 500 nm sized magnetic dust in conjunction with a mineral oil agent, for example only and not by way of limitation, works very well. The advantages of a liquid magnetic solution 25 are that it appears to produce fluid dynamics different from and more effective than other forms of magnets. Applicant's research suggests that the difference between the speed and reactivity of solid magnetic bars and the liquid magnets of the present invention is significant. It appears that solid magnetic tubes do not react as fast as liquid filled tubes in the creation of a perfected wave form so as to enable a full range of perfected tuning as process flows and outside magnetic signatures change and place torque on the magnetic field. Applicant has determined that liquid magnets can respond to tuning in a wave form whereas solid tubes must move as a unit. It appears that liquid magnets provide a dampening effect whereas solid magnets tend to rock of show spring reactions as they try to adjust and making them less efficient.

Applicant believes that tuning is improved due to the mixing of air and fuel being integrated together inside the air intake funnel 12 before entering the combustion zone, the interior of magnetic tube container 18. Because the air and fuel are directly tied and undergoing together or simultaneously the exposure to the magnetic fields created by magnetic tubes 24, a new resource or process for ignition has been established for oxygen atoms to chemically react more efficiently with carbon. Applicant believes that as a part of high velocity flow process the invention's intake design allows for excitation derived from freed electrons as molecules break in the magnetic fields produced when moving past the magnetic tubes 24. This effect in turn produces a new process for enabling specialized tuning for mixing to the precision of self ignition.

Referring now to FIG. 3, another important feature of the invention is illustrated. As described above, Applicant has determined that misalignment of the magnetic tubes 24 within magnetic tube container 18, even by a little, helps increase the effect of the device by continuously mixing the air 43 and fuel 42 as it passes through magnetic tube container 18. Further it ensures that the air 43 and fuel 42 comes into contact with each magnetic tube 24. Applicant has determined that one particularly effective result is obtained by connecting magnetic tubes 24 in a "spiral" fashion as shown in the figure. Again, this "spiral" connection format has been found to enhance the combustion of fuel 42 apparently because it most effectively causes the air 43 fuel 42 mixture to at least partially spiral through the magnetic tube container 18. Further, it appears to be most effective in causing the mixture to more fully contact each magnetic tube 24 along the passage.

By way of continued explanation, Applicant's high velocity burner 10 has several advantages over prior art burners. To begin with, the high velocity burner 10 according to one embodiment has no small fuel nozzle atomization ports in its fuel delivery design. These prior art nozzles often give trouble in conventional burner equipment nozzle design by fouling by small solids blocking the tiny orifice. Applicant's nozzle at fluid input 16 may be as large as six inches in diameter for very large systems.

Additionally, Applicant's burner 10 has the ability to allow specialized tuning to the combustion process where much less volumes of ambient air or oxygen are needed in order to provide a completed combustion. Thus, thereby, improving on BTU loss of energy by avoiding heat loss normally contained in the exhaust as well as the massive displacement of unwanted atmospheric nitrogen to combustion process.

Further, Applicant's burner 10 allows for less combustion turbulence normally produced by the forced combustion air flow common to the current burner designs, However, Applicant's structured design reduces emissions solids or dust carryover as well as many unwanted emission gases due to the Applicant's burner 10 delivering the combustion absent the volumetric displacements of regular combustion burner design. The Applicant realized that a problem existed in the typical fuel spray design and air flow delivery system of combustion burners as discussed above. It appeared to the Applicant that most problems with modern burner equipment were associated with the fact that they are dependent upon fuels which had to be highly filtered or processed in such a way as to eliminate micro sized particles that would otherwise plug the burner spray nozzles. Applicant's invention as set forth herein resolves this problem by using an entirely different methodology and by deploying a fuel and air flow mixing concept which no longer deploys a typical atomizing fuel spray nozzle at all. The high velocity burner 10 of the present invention does not depend upon the typical spray of a small sized nozzle in order to achieve what historically has been referred to as "nozzle spray atomization". As a result, fuel quality and/or contamination problems associated with the size of the typical spray nozzle configurations are resolved by producing a high velocity air flow directed in such a way as to disperse and direct the fuel and air for precision mixing inside the helical design and molecular arrangement process deployed by the intake configuration as set forth herein. It is important to note that while flow velocity and mixing is occurring inside the intake configuration, i.e. within magnetic tube container 18, at very high speeds the over all cubic feet of atmospheric air flow displacement has been reduced with this burner design while still enabling combustion conditions for allowing fully combusted fuels. However, the greatly reduced total air flow displacement of this invention allows for greater heat absorption inside the process equipment and less flow turbulence. On the other hand, a typical prior art burner configuration supports the carryover of ash and particulate solids that in turn add to the fugitive emission problems of unwanted smoke stack pollutants. The present invention's improved air and fuel ratio mixing allows for less over all ambient air supply to be necessary in order to combust the fuel loading. The present invention also allows for the mixing and combustion of multiple fuels such as bio-fuel and regular petroleum products in situations where a blending of fuels can help accommodate the over all price of fuel or to develop more heat release for energy as well as to accommodate extreme hot or cold weather conditions.

Also, Applicant's burner 10 allows for multiple types of fuel and combinations of fuel loading through one fuel feed port, fluid input 16. Also, Applicant's burner 10 delivers electrostatic energy over and throughout the total fuel and oxygen mix within magnetic tube container 18 allowing for a faster more complete ignition for the oxidative or combustion process to accrue. Applicant has concluded that the structure of the invention results in a burner 10 that is like having thousands of times more spark surface for ignition, compared to a normal, prior art burner that delivers its ignition spark from an electric transformer to the isolated space of a spark gap.

Additionally, Applicant has determined that the burner 10 is much more adept at combusting Bio-fuels that contain micro-solids due to the lack of nozzle fouling and improved air mixing, as discussed above. Thus, the Applicant's burner 10 will stimulate alternative fuel usage and renewable energy resources to continue development for lower costing clean emission Bio-fuel. Importantly, Applicant has confirmed by testing that the burner 10 of the present invention requires 30% less electrical power energy to drive the combustion air supply fans, air suction device 32, than that of a burner with equal BTU capacity.

Applicant has determined that the burner 10 of the present invention, among other things, allows for a new process of hydrogen generation and hydrogen recovery normally lost to the unwanted formation of nonburnable H2O. This recovery and hydrogen generation is unique and beneficial to the overall combustion as hydrogen greatly improves over all heat yield as well as reduces emission by supporting other components of the fuel process. Applicant has concluded that burner 10 through its design and combustion ignition process advancement has in effect allowed for a new initiations electrolysis. That is, the burner 10 enables a new process for generating additional combustible materials from more complex molecular structures normally difficult to consider even combustive. Again, Applicant has observed and believes the process works in such a way that the high velocity suction being drawn through the burner 10 in combination with the MHD effect produced by the design imparts massive electron exchange directed by conductive magnetic flux density resulting in disruption of normal molecular level covalent bonding thereby allowing most molecules to continue breaking apart, thus creating a new molecular level de-manufacturing process tool.

By way of continued explanation, the central elements of the above described invention include fluid input 16. This is where fuel 42, in the form of many different types of combustibles and or disposables, is introduced into the burner 10, through a simple nozzle (not shown), in order that the electrostatic forces of MHD effect perform molecular level demanufacturing as the excitations or electron flow generated by the high velocity flow stream pass through the magnetic fields of the magnetic tubes 24 intake configuration and break the covalent bonds holding complex molecular structures together in such a way that oxidation rapidly occurs due to the oxygen gaining access to react with carbon more efficiently. Thus, thereby this process enables a new over all self refining or self fueling combustion process derived from crudely manufactured bio-fuels or waste slurry used as a energy feed stock.

Applicant's fluid input 16 eliminates conventional restrictive small hole nozzle design. This approach allows fluids that have a high viscosity and high specific gravity to become small particles able to distribute and travel the intake design. Further, air intake funnel 12 is large and, preferably, fluid is introduced at approximately right angles through fluid input 16 to the incoming air 43. This enhances the break up of the fuel 42 prior to entrance into magnetic tube container 18.

Magnetic tube container 18 is an electrostatic mixing chamber in which magnetic tubes 24, preferably 316 Stainless steel rods filled with a liquid magnetic solution, create the above described and desired magnetic effects.

Air suction device 32 is an intake suction/burner blower fan and housing. Preferably air suction device 32 is a high heat design turbo charged fan. Flame exhaust 50 is illustrated exiting from burner device 38. It should be noted that Applicant's invention does not require conventional ignition resources in order to initiate the combustion process. Due to the high electron exchange developed inside the unit during air/and mass flow conditions the oxidation rate ramps up to levels of enhancement ignition, thereby, eliminating many problems in combusting low BTU and difficult to ignite energy resources.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A high velocity burner apparatus comprising:

a. an air intake funnel;

b. an air-fluid mixer connected with said air intake funnel;

c. a fluid input connected with said air-fluid mixer for introducing fluid to said air-fluid mixer;

d. a magnetic tube container with an entrance and an exit wherein said entrance is connected with said air-fluid mixer wherein said magnetic tube container includes a plurality of individual magnetic tubes connected within said magnetic tube container from side to side across the magnetic tube container such that adjacent magnetic tubes are misaligned with each other;

e. an air suction device connected at said exit of said magnetic tube container such that suction is applied through said magnetic tube container to said air intake funnel; and f. a burner device connected with said air suction device for burning said fluid that passes from said air-fluid mixer through said magnetic tube container after said fluid passes over and around said plurality of individual magnetic tubes wherein the magnetic tubes are hollow tubes filled with at least one selected from the group consisting of a liquid magnetic fluid combination and solid magnetic bars and wherein the magnetic tube container is a hollow tube.

2. The apparatus of claim 1 wherein said fluid input is connected at approximately a right angle with said air-fluid mixer such that fluid introduced into said air-fluid mixer enters said air-fluid mixer at approximately a right angle to air entering said air-fluid mixer.

3. The apparatus of claim 1 wherein said magnetic tube container encompasses an interior space with sides and a center and said plurality of individual magnetic tubes are connected within said magnetic tube container across an approximate center of the magnet tube container from side to side.

4. The apparatus of claim 1 wherein said plurality of individual magnetic tubes are connected within said magnetic tube container in an approximate spiral pattern as viewed from said entrance such that air and fluid passing through said magnetic tube container is caused to move around said plurality of individual magnetic tubes in a spiral motion.

5. The apparatus of claim 1 wherein said plurality of individual magnetic tubes are hollow tubes filled with a liquid magnetic fluid combination.

6. The apparatus of claim 1 wherein said air suction device is a blower with a suction end and an exhaust wherein said suction is connected with said exit of said magnetic tube container and said exhaust is connected with said burner device.

7. The apparatus of claim 1 wherein said fluid input is connected with a fuel source and directs fuel into said air-fluid mixer.

8. The apparatus of claim 7 wherein said fuel is a bio fuel.

9. The apparatus of claim 7 wherein said fuel is a waste slurry.

10. A high velocity burner apparatus comprising:

a. an air intake funnel wherein said air intake funnel includes a mouth and a throat wherein said mouth is larger in dimension than said throat;

b. an air-fluid mixer connected with said air intake funnel;

c. a fluid input for introducing fluid to said air-fluid mixer connected with said air-fluid mixer wherein said fluid input is connected at approximately a right angle with said air-fluid mixer such that fluid introduced into said air- fluid mixer enters said air-fluid mixer at approximately a right angle to air entering said air-fluid mixer;

d. a magnetic tube container with an entrance and an exit wherein said entrance is connected with said air-fluid mixer, wherein said magnetic tube container encompasses an interior space with sides and a center and wherein said magnetic tube container includes a plurality of individual magnetic tubes connected with said sides within said magnetic tube container such that adjacent magnetic tubes are misaligned with each other and wherein said plurality of individual magnetic tubes are connected within said magnetic tube container across an approximate center of the magnet tube container from side to side;

e. an air suction device connected at said exit of said magnetic tube container such that suction is applied through said magnetic tube container to said air intake funnel; and f. a burner device connected with said air suction device for burning said fluid that passes from said air-fluid mixer through said magnetic tube container after said fluid passes over and around said plurality of individual magnets wherein the magnetic tubes are hollow tubes filled with at least one selected from the group consisting of a liquid magnetic fluid and solid magnetic bars wherein the magnetic tube container is a hollow tube.

11. The apparatus of claim 10 wherein said plurality of individual magnetic tubes are connected within said magnetic tube container in an approximate spiral pattern as viewed from said entrance such that air and fluid passing through said magnetic tube container is caused to spiral.

12. The apparatus of claim 10 wherein said plurality of magnetic tubes are hollow tubes filled with a liquid magnetic fluid combination.

13. The apparatus of claim 10 wherein said air suction device is a blower with a suction end and an exhaust wherein said suction end is connected with said exit of said magnetic tube container and said exhaust is connected with said burner device.

14. The apparatus of claim 10 wherein said fluid input is connected with a fuel source and directs fuel into said air-fluid mixer.

15. The apparatus of claim 13 wherein said fuel is a bio fuel.

16. The apparatus of claim 13 wherein said fuel is a waste slurry.

17. A high velocity burner method comprising:

a. providing a high velocity burner with an air intake funnel, an air-fluid mixer connected with said air intake funnel, a fluid input for introducing fluid to said air-fluid mixer connected with said air-fluid mixer, a magnetic tube container with an entrance and an exit wherein said entrance is connected with said air-fluid mixer and wherein said magnetic tube container includes a plurality of individual magnetic tubes connected within said magnetic tube container from side to side across the magnetic tube container such that adjacent magnetic tubes are misaligned with each other, an air suction device connected at said exit of said magnetic tube container such that suction is applied through said magnetic tube container to said air intake funnel and a burner device connected with said air suction device for burning said fluid that passes from said air-fluid mixer through said magnetic tube container after said fluid passes over and around said plurality of individual magnetic tubes;

wherein the magnetic tubes are hollow tubes filled with at least one selected from the group consisting of a liquid magnetic fluid combination an solid magnetic bars, wherein the magnetic tube container is a hollow tube and b. connecting a fluid source with said fluid input.

18. The method of claim 17 wherein said plurality of individual magnetic tubes at hollow tubes filled with a liquid magnetic fluid combination.

19. The method of claim 17 wherein said fluid source is a bio fuel.

20. The method of claim 17 wherein said fluid source is a waste slurry.

* * * * *